United States Patent [19]

Takahashi

[11] Patent Number: 4,768,059

[45] Date of Patent: Aug. 30, 1988

[54] DEVELOPING METHOD FOR ELECTROPHOTOGRAPHIC APPARATUS

[75] Inventor: Kazuo Takahashi, Kanagawa, Japan

[73] Assignee: Fuji Photo Film Co., Ltd., Kanagawa, Japan

[21] Appl. No.: 106,290

[22] Filed: Oct. 9, 1987

[30] Foreign Application Priority Data

Oct. 9, 1986 [JP] Japan ..... 61-240231

[51] Int. Cl.[4] ..... G03G 15/10

[52] U.S. Cl. ..... 355/10; 355/140; 354/312; 430/117

[58] Field of Search ..... 355/10, 3 R, 14 D, 14 R, 355/16, 27; 354/300, 317, 312; 118/647, 662; 430/32, 117

[56] References Cited

U.S. PATENT DOCUMENTS 3,916,828 11/1975 Gross ..... 118/647
3,964,828 6/1976 Yamada et al. ..... 355/10
4,435,071 3/1984 Kuehnle ..... 355/10
4,622,915 11/1986 Ohtsuka et al. ..... 355/10 X
4,623,240 11/1986 Kimura et al. ..... 355/10
4,627,705 12/1986 Landa et al. ..... 355/4
4,727,393 2/1988 Ohtsuka et al. ..... 355/10 X

*Primary Examiner*—A. C. Prescott
*Attorney, Agent, or Firm*—Sughrue, Mion, Zinn, Macpeak and Seas

[57] ABSTRACT

A developing method in an electrophotographic apparatus in which an image on an electrophotographic film brought into a developing section is developed by a developer supplied to the developing section. During the development, a seal gas of a pressure higher than the pressure in the developing section is supplied to a seal section around the developing section so that the seal gas is forced to flow into the developing chamber to stir the developer in the developing section, thus eliminating any degradation of the quality of the developed image attributable to stagnation of the developer.

13 Claims, 15 Drawing Sheets

DEVELOPING METHOD FOR ELECTROPHOTOGRAPHIC APPARATUS

BACKGROUND OF THE INVENTION

1. Field of the Invention

The present invention broadly relates to an electrophotographic apparatus and, more particularly, to a developing method for developing images on an electrophotographic film in the electrophotographic apparatus.

2. Description of the Related Art

Electrophotographic apparatus has been known in which an image is recorded in a predetermined frame of an electrophotographic film in such a manner that the recorded image can be projected or copied as desired.

The electrophotographic apparatus of the kind mentioned above employs a processing head adapted for conducting various types of processing such as charging/exposure and development on the electrophotographic film. Examples of such a processing head is disclosed in U.S. Pat. Nos. 4,591,543, 4,600,291, 4,622,915, 4,623,240, 4,624,554 and so on.

The processing head disclosed in the above-mentioned publications has a charging/exposure section, a developing section, a drying section and a fixing section which are arranged in series in the mentioned order along the path of feed of the electrophotographic film, at a pitch or interval which corresponds to the pitch of frames on the electrophotographic film.

In the charging/exposure section, the portion of the electrophotographic film located in this section, constituting one frame, is charged and then exposed to an image light from an original, so that an electrostatic latent image corresponding to the pattern of an image carried by the original is formed in this portion of the film. The film is then fed so as to bring the exposed frame to the developing section where a liquid developer is applied to the electrophotographic film so as to develop the latent image thereby making it visible. Subsequently, the frame is brought to the drying section where drying air is blown to the electrophotographic film wetted by the liquid developer, so as to remove moisture component from the film. Finally, the frame is brought to the fixing section where the developed image is fixed to the electrophotographic film by means of, for example, a fixing lamp. The whole system of the aforesaid electrophotographic apparatus and a method of recording and retrieval of an image frame are disclosed in U.S. Pat. No. 4,671,648.

In order to sufficiently and uniformly apply the developer to the whole area of the exposed portion of the electrophotographic film, the developing section usually employs a system which applies a certain level of pressure to the developer. It is also a common measure to supply pressurized air to get rid of any surplus developing agent after the supply of the same. In some cases, a control of the pressure of the air is conducted such that, in the beginning period of supply of pressurized air, the air pressure is kept comparatively low so as not to cause the developer to be exfoliated from the electrophotographic film but is elevated in the later period.

The described known technique encounters the following problems. Namely, the supply of the pressurized air tends to cause any portion of the liquid developer stagnant in and attaching to various portions of the developing chamber to drip onto the image, thereby degrading the developed image due to so-called "drag".

Even when the supply of the pressurized air is not conducted, inferior development may result from formation of bubbles in the developer caused by inclusion of air which tends to be introduced into the developer due to incorrect timing of operation of a solenoid valve which is used for the control of supply of the developer. Furthermore, dripping of the liquid developer and bubbling in the same tend to hamper the sensing operation of a sensor which controls the feed of the film.

SUMMARY OF THE INVENTION

Accordingly, an object of the present invention is to provide a developing method for use in an electrophotographic apparatus which can eliminate any unfavorable effect produced by bubbles in the liquid developer and stagnation of liquid developer, so as to enable the development to be conducted under appropriate condition without suffering any degradation such as distortion and unevenness of the developed image, thereby overcoming the above-described problems of the prior art.

To this end, according to the present invention, there is provided a developing method for use in an electrophotographic apparatus of the type having a developing section which is defined by a frame and which is adapted to be supplied with a developer so as to develop an image on an electrophotographic film brought to the developing section, the developing method comprising the steps of (a) supplying the developer into the developing section; and (b) supplying a seal section provided around the frame defining the developing section with a seal gas of a pressure higher than the pressure in the developing section, in such a manner as to allow the seal air to flow from the seal section into the developing section thereby stirring the developer in the developing section during development.

According to the invention, the seal gas introduced through the seal section effectively stirs the liquid developer in the developing chamber so that any bubble which may have been included in the liquid developer supplied into the developing chamber is not allowed to stand still, so that degradation of the developed image which may otherwise be caused by the stagnant bubbles is avoided. The seal air introduced into the developing chamber also serves to stir any portion of the liquid developer stagnant in the developing chamber so as not to allow such portion of the liquid developer to remain on the surface of the film carrying the image.

The above and other objects, features and advantages of the present invention will become clear from the following description of the preferred embodiment when the same is read in conjunction with the accompanying drawings.

DESCRIPTION OF THE PREFERRED EMBODIMENT

(General Construction of Electrophotographic Apparatus)

Figure 1:
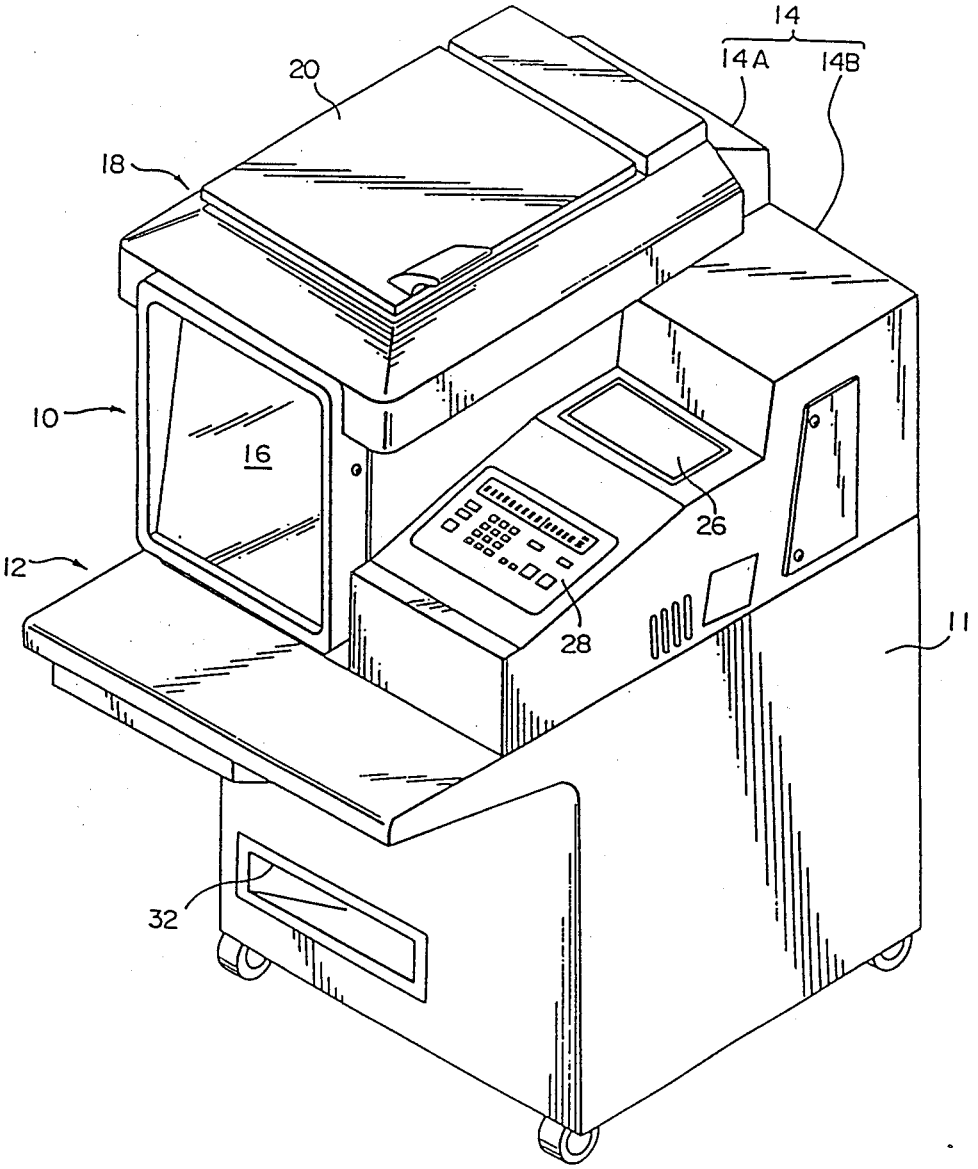
FIG. 1 is a perspective view of an electrophotographic apparatus to which the present invention pertains.

FIG. 1 shows one example of an electrophotographic apparatus having a processing head to which the present invention pertains. The electrophotographic apparatus has various functions: namely, the camera function which enables the image of a document to be recorded on an electrophotographic film; the reader function which enables the image recorded on the film to be enlarged and projected on a screen; and the copy function which enables the image recorded on the film to be enlarged and copied on a sheet of copying paper.

The electrophotographic apparatus has on integral structure which consists of an electrophotographic apparatus body 10, a housing 11, and a copying machine 12 serving also as a table for mounting the body 10. When the copy function is not needed, the electrophotographic apparatus body 10 may be used alone. The apparatus body 10 includes a housing 14 which consists of a left-hand portion 14A having a substantially rectangular parallelopiped configuration and a right-hand portion 14B which has a stepped upper surface. The respective internal spaces of these portions 14A and 14B are communicated with each other at the side thereof which is closer to the rear end of the apparatus.

A rear projection screen 16 is disposed in the housing portion 14A in such a manner that the screen 16 closes an opening provided in the front side of the housing portion 14A and it is slightly slanted rearwardly. A document table 18 is disposed on the upper side of the housing portion 14A. The document table 18 includes a document pressing plate 20 which can be opened and closed as desired, and a transparent glass plate 22 (see FIG. 2) which is disposed underneath the plate 20 in such a manner as to close an opening provided in the upper side of the housing portion 14A. A cassette loading section 26 into which a cassette accommodating an electrophotographic microfilm 24 (see FIG. 2; hereinafter referred to as an "electrophotographic film") is loaded is provided in the central portion of the upper side of the housing portion 14B. A control keyboard 28 through which various controls of the electrophotographic apparatus are effected is disposed on the front portion of the upper side of the housing portion 14B.

Figure 4:
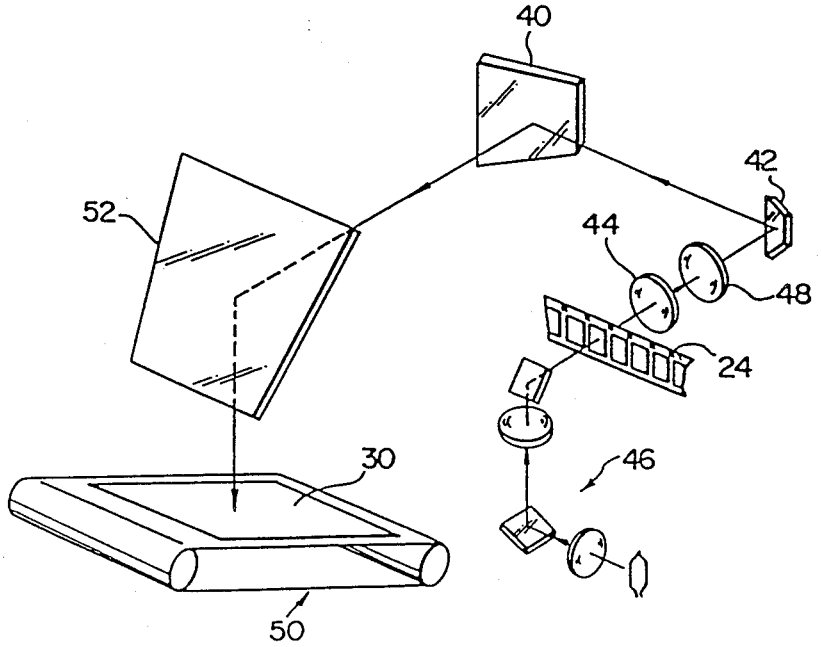
FIG. 4 is perspective view illustrating the concept of a copying optical system in the electrophotographic apparatus.

The housing 11 of the copying machine 12 is provided with an opening 32 for delivering a copied sheet of paper 30 (see FIG. 4).

[Optical Systems of Electrophotographic Apparatus]

Figure 2:
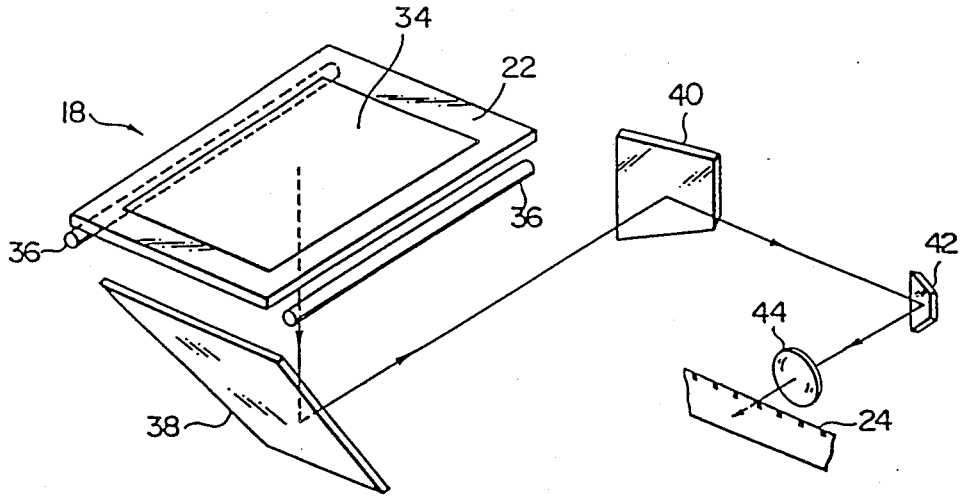
FIG. 2 is a perspective view illustrating the concept of a photographing optical system in the electrophotographic apparatus.
Figure 3:
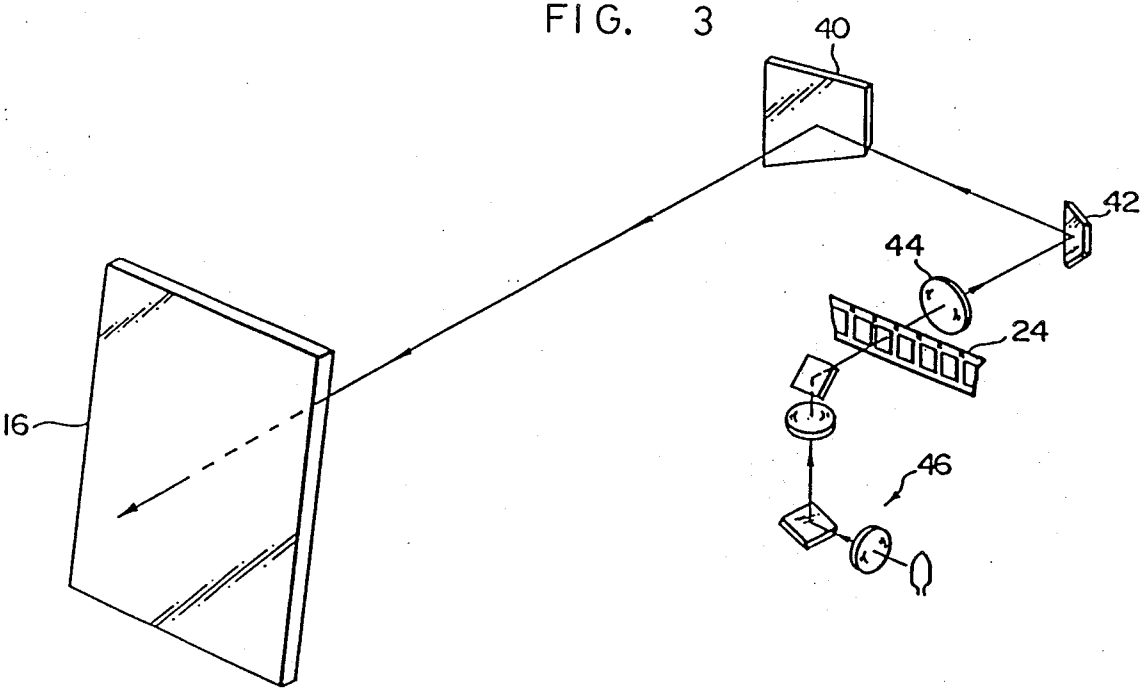
FIG. 3 is a perspective view illustrating the concept of a projecting optical system in the electrophotographic apparatus.

FIGS. 2 to 4 show various optical systems of the electrophotographic apparatus.

Referring first to FIG. 2, the recording optical system includes a document illumination lamp 36 which illuminates a document 34 as a subject which is set on the glass plate 22 of the document table 18 in such a manner that the document surface faces downward, a third mirror 38 on which the light reflected from the document 34 is made incident, a second mirror 40 on which the light reflected from the third mirror 38 is made incident, a first mirror 42 on which the light reflected form the second mirror 40 is made incident, and a main lens 44 for focusing the light reflected form the first mirror 42 on the surface of an electrophotographic film 24.

Referring next to FIG. 3, the projecting optical system includes a projecting light source section 46 for irradiating the electrophotographic film 24, the main lens 44 for focusing the light passing through the film 24 on the first mirror 42, the second mirror 40 on which the light reflected from the first mirror 42 is made incident, and the screen 16 on which the light reflected from the second mirror 40 is projected.

As shown in FIG. 4, the copying optical system includes the projecting light source section 46, the main lens 44, the first mirror 42, the second mirror 40, a conversion lens 48 disposed between the main lens 44 and the first mirror 42 to slightly reduce the optical image formed on the first mirror 42, and a copy mirror 52 adapted to reflect the light reflected from the second mirror 40 toward a sheet of copying paper 30 set on an exposing table 50 disposed in the copying machine 12.

The main lens 44 and the first and second mirrors 42, 40 are mutually used for the above-described three optical system. The main lens 44 and the first mirror 42 are fixedly disposed within the housing portion 14B of the electrophotographic apparatus body 10, while the second mirror 40 is fixedly disposed within the housing portion 14A.

The third mirror 38, the copy mirror 52, the conversion lens 48 and the screen 16 are selectively used. The third mirror 38 and the copy mirror 52 are movably disposed within the housing portion 14A of the apparatus body 10, while the conversion lens 48 is movably disposed within the housing portion 14B so that the lens 48 is prevented from interfering with any other optical system. Since the screen 16 does not interfere with any other optical systems, it is fixedly disposed as described above.

In addition, a shutter (not shown) which is controlled by an automatic exposure controller is disposed between the main lens 44 and the first mirror 42 in the optical systems of the electrophotographic apparatus.

[Processing Head]

FIGS. 5 to 13 show in combination an example of the processing head according to the present invention which is disposed in the above-described electrophotographic apparatus.

Figure 5:
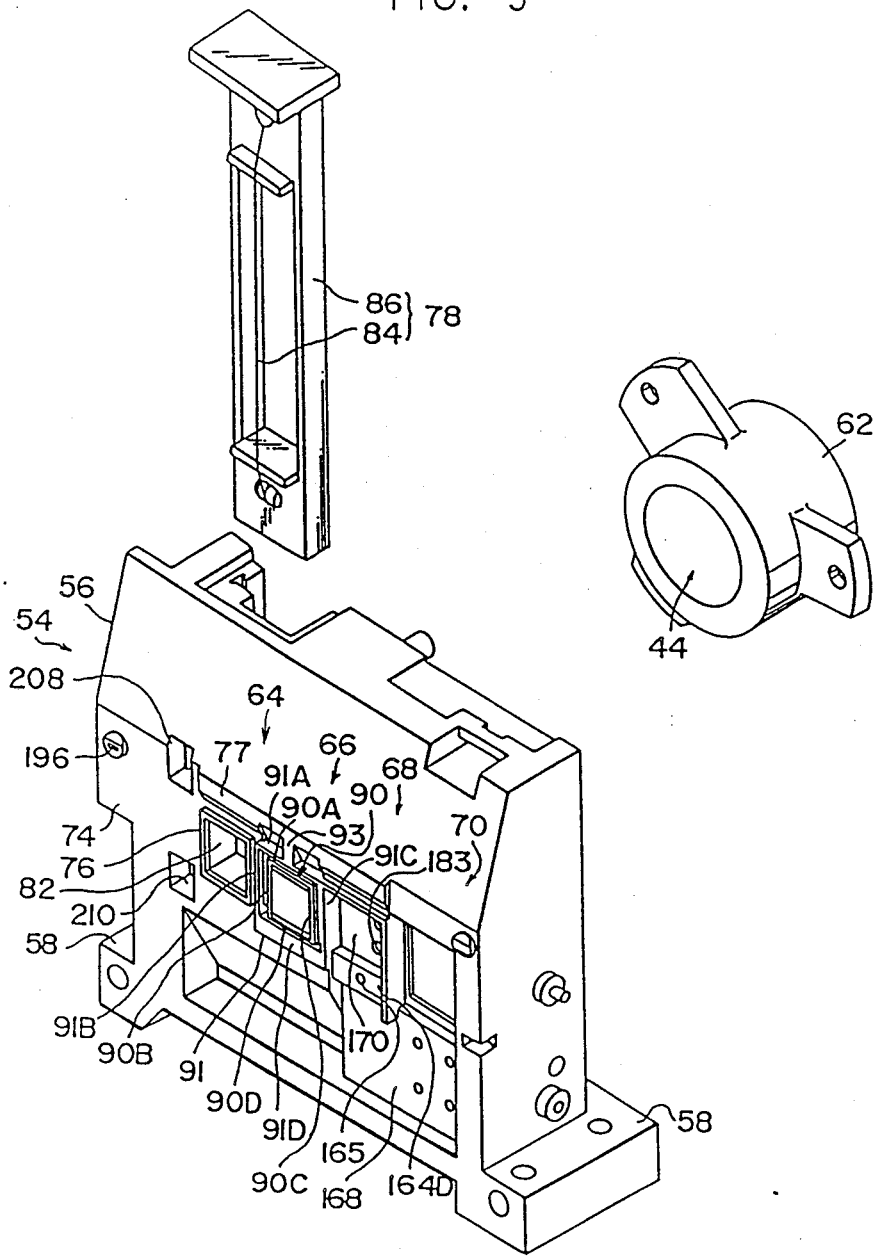
FIG. 5 is an exploded perspective view of a processing head embodying the developing method in accordance with the present invention and incorporated in the electrophotographic apparatus shown in FIG. 1.
Figure 6:
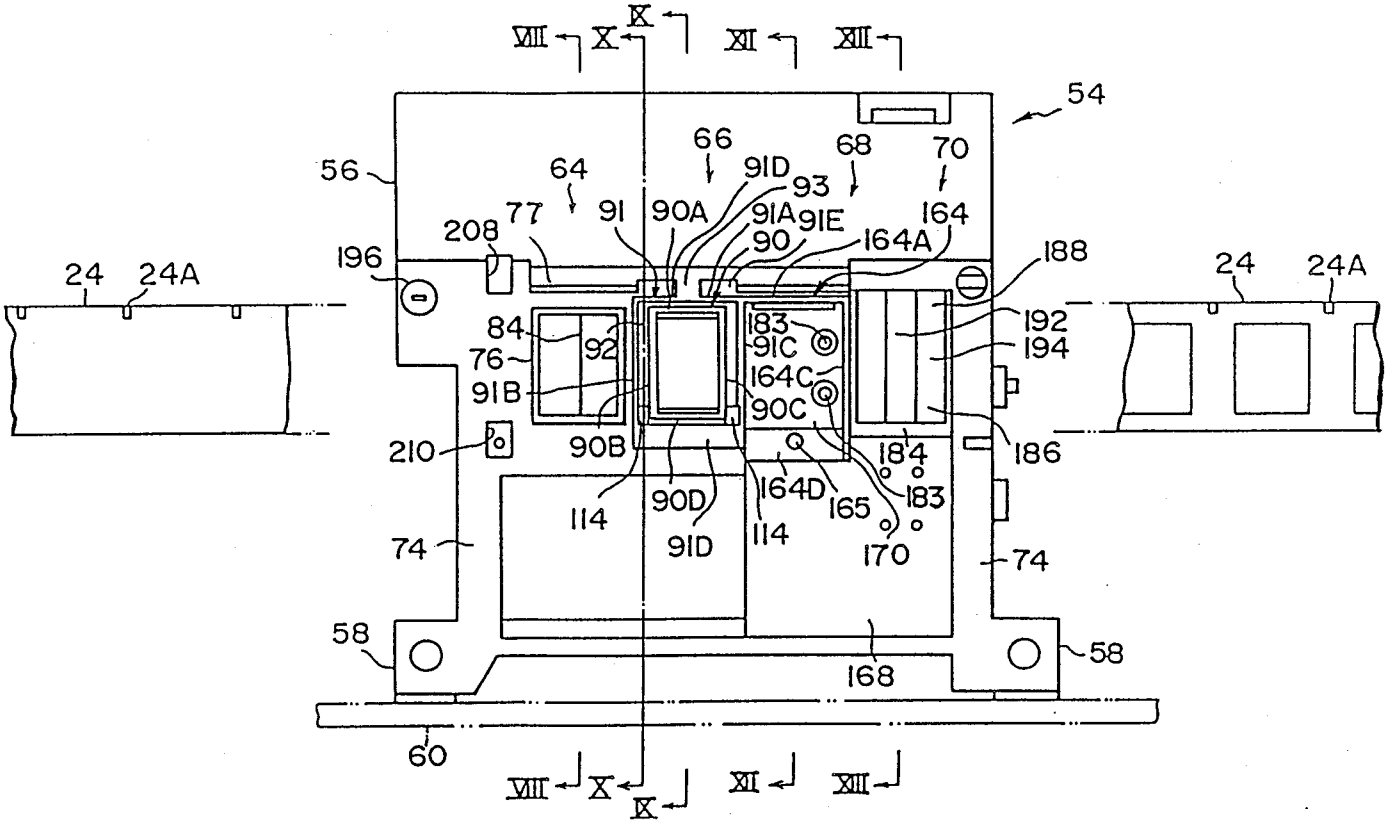
FIG. 6 is a front elevational view of the processing head shown in FIG. 5.

Referring first to FIGS. 5 and 6, the processing head 54 has an integral structure which consists of a relatively flat body portion 56 having a substantially rectangular parallelopiped configuration, and a pair of leg portions 58 located below the body portion 56. The processing head 54 is formed from a synthetic resin by an integral molding process except for fitting members. The processing head 54 is disposed between the main lens 44 and the electrophotographic film 24, which are shown in FIGS. 2 to 4, and the leg portions 58 are secured to a frame 60 disposed within the housing portion 14B of the apparatus body 10, as shown in FIG. 6.

Figure 7:
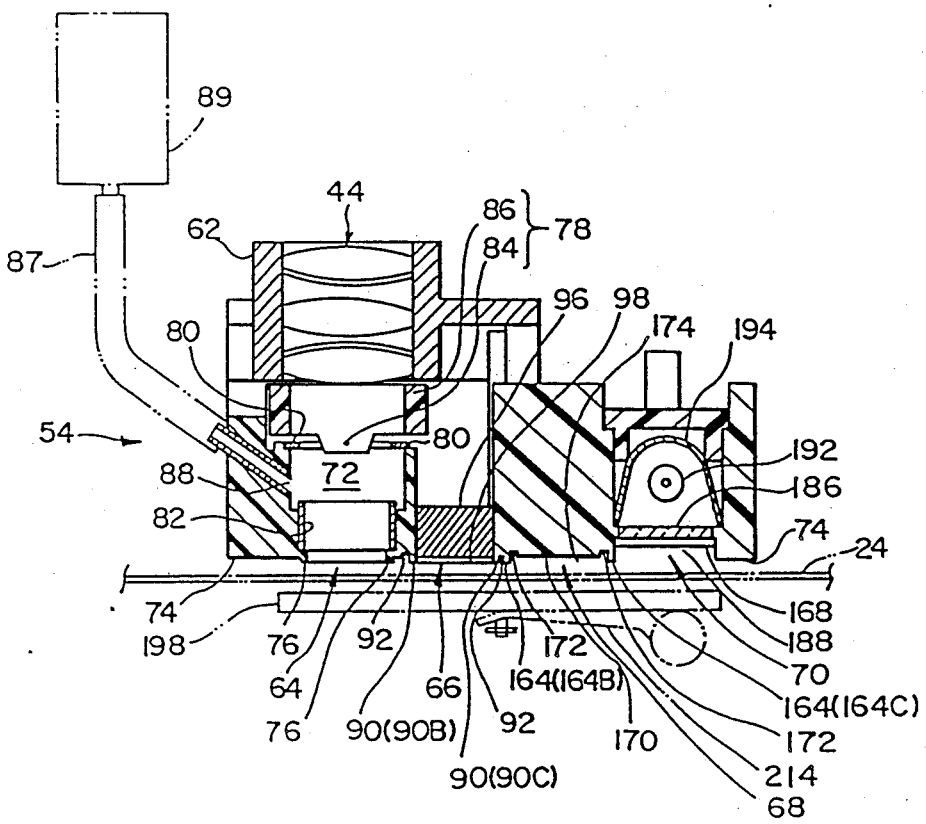
FIG. 7 is a sectional view taken along the line VII—VII in FIG. 6.

The main lens 44 is, as shown in FIGS. 5 and 7, fitted in a lens tube 62 which, in turn, is secured to the rear side of the processing head 54. The electrophotographic film 24 is formed by successively coating a transparent electrically conductive layer, an intermediate layer and a photosensitive layer on a carrier of, e.g., polyethylene. The photosensitive layer consists of a photoconductive layer and a protective layer for protecting the photoconductive layer. This electrophotographic film 24 is formed in the shape of a continuous tape and accommodated in a cassette casing.

Blip marks 24A are printed on the film 24 along the upper edge (as viewed in FIG. 6) thereof at a predetermined regular spacing in the longitudinal direction thereof. Each blip mark 24A is provided in correspondence with one frame for an image which is to be recorded on the film 24. The film 24 is disposed in such a manner that the photosensitive layer side thereof faces the front side of the processing head 54, and is movable in the lateral direction (the horizontal direction as viewed in FIG. 6) of the processing head 54 by driving a film moving motor (not shown). The transparent electrical connection with the apparatus body 10 when the cassette is loaded therein. It is a matter of course that any type of known electrophotographic film may be employed in addition to the film of the type described above.

As shown in FIGS. 5 to 7, a charging/exposure section 64, a developing section 66, a drying section 68 and a fixing section 70 are successively formed in the body portion 56 of the processing head 54 along the lateral direction thereof at a constant pitch which corresponds to the frame pitch of the film 24.

[Charging/Exposure Section]

Figure 8:
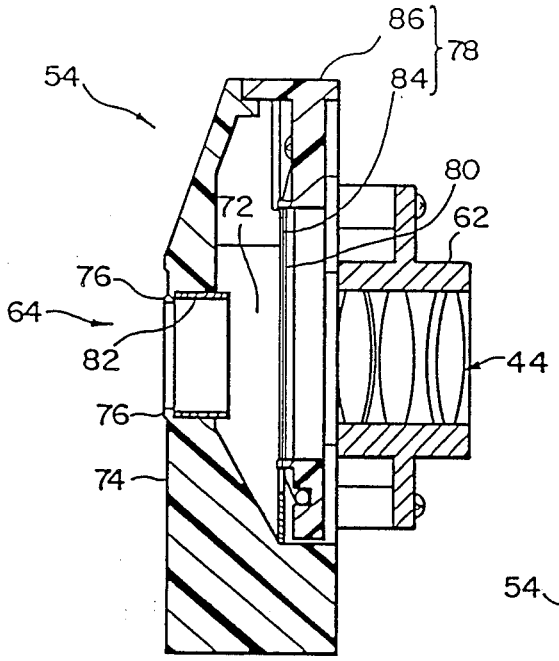
FIG. 8 is a sectional view taken along the line VIII—VIII in FIG. 6.

As shown in FIGS. 7 and 8, the charging exposure section 64 has a charging exposure chamber 72 which is defined by an internal space provided on the reverse side of a front wall 74 of the processing head 54. The chamber 72 is communicated with an opening provided in the front wall 74 of the head 54. As also shown in FIGS. 5 and 6, a mask 76 is formed along the peripheral edge of the opening in the front wall 74, the mask 76 slightly projecting from the surface of the front wall 74. The mask 76 defines a rectangular opening the size of which corresponds to one frame of the film 24. In the charging exposure chamber 72 are disposed a corona unit 78, proximity electrodes 80 and a mask electrode 82.

As shown in FIG. 5, the corona unit 78 consists of a corona wire 84 and a holder 86 made of a synthetic resin and adapted to hold the corona wire 84, the unit 78 being inserted into the processing head 54 from the upper side thereof. The proximity electrodes 80 are respectively defined by relatively narrow metal plates and disposed on both sides of the corona wire 84. The mask electrode 82 is formed by bending a metal plate in a square shape, and disposed in the vicinity of the opening in the front wall 74. The corona wire 84 is connected to a high-voltage power supply, while the proximity electrodes 80 and the mask electrode 82 are electrically connected to each other. In general, the proximity electrodes 80 are connected directly to the ground, while the mask electrode 82 is connected to the ground through an electrical resistance. However, bias voltages which are different from each other may be respectively applied to the proximity and mask electrodes 80 and 82 from an external power supply.

As shown in FIG. 7, a film cooling air inlet 88 is opened into the charging exposure chamber 72 so that cold air is supplied to the chamber 72 with an air pump 89 through a conduit 87. The main lens 44, which is mounted on the rear side of the processing head 54 through the lens tube 62, has the optical axis thereof made coincident with the center of the opening defined by the mask 76.

The charging/exposure section 64 has a transversely-extending guide projection 77. The guide projection 77 has the same height as the mask 76 and is intended for preventing, when the electrophotographic film 24 is set in the cassette loading section 26 together with the cassette, the electrophotographic film 24 from being caught by the mask 76 on the front wall 74 of the main part 56 of the processing head 56. To this end, the surfaces on the upper and lower sides of the guide projection 77 are tapered such as to progressively decrease the height.

[Developing Section]

As shown in FIGS. 5 and 6, the developing section 66 has a mask 90. The mask 90 is defined by an upper frame member 90A, left and right frame members 90B, 90C, and a lower frame member 90D which protrude from the front wall 74. The height or amount of protrusion of the mask 90 is the same as that of the protrusion of the mask 76 in the charging/exposure section. An outer frame 91 also protrude from the front wall 74 so as to surround the frame 91, thus forming a recess 92 between itself and the mask 90. The height or amount of protrusion of the outer frame 91 is the same as that of the mask 90. The recess 92 surrounds the mask 90. As is the case of the mask 90, the outer frame 91 has an upper frame member 91A, left and right frame members 91B, 91C, and the lower frame member 91D. The central portion of the upper frame member 91A is connected through a narrow guide projection 93 to a horizontal guide projection 77 which extends horizontally from an upper portion of the charging/exposure section 64. The width of the recess 92 is greater at the portion between the upper frame members 90A and 91A and at the portion between the lower frame members 90D and 91D than at the portion between the left frame members 90B and 91B and the portion between the right frame members 90C and 91C.

The guide projection 93 plays the same role as the guide projection 77 of the charging/exposure section 64. The lower frame member 91D of the outer frame 91 has a width which is greater than that of other frame members 91A, 91B and 91C of the same. The portion between the guide projection 77 on the upper portion of the developing section 66 and the upper frame member 91A of the outer frame 91 has the form of a groove 91E the depth of which is progressively increased towards the upper frame member 91A. The maximum depth of the groove 91E is greater than that of the The width of the opening defined by the mask 90 is set such as to be slightly smaller than that of the opening defined by the mask 76. The vertical height of the opening defined by the mask 90, that is, the distance between the respective inner walls of the upper and lower frame members 90A and 90D, is set such as to be larger than that of the opening defined by the mask 76 since the inner wall of the lower frame member 90D is positioned lower than that of the mask 76.

Figure 9:
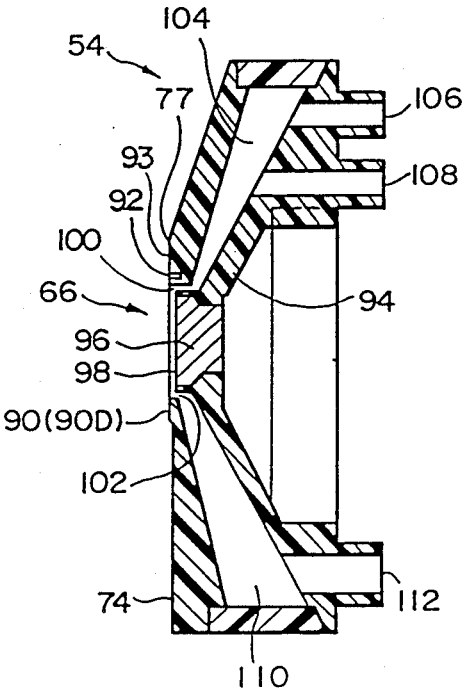
FIG. 9 is a sectional view taken along the line IX—IX in FIG. 6.

As shown in FIG. 9, a developing electrode 96 is disposed within the opening defined by he mask 90, the electrode 96 being supported by a rear wall 94. The developing electrode 96 is connected to a bias power supply. As will be seen from FIG. 16, one a plurality of types of electric voltage including a voltage VA (100 volts), a voltage VB (−140 volts), a voltage VM (−200 to −400 volts) and a voltage VN (−1000 volts) is selectively applied to the developing electrode 96.

The developing electrode 96 is positioned in such a manner that the outer surface thereof is located at a position which is slightly inner than the end face of the mask 90. The space surrounded by the developing electrode 96 and the inner walls of the mask 90 defines a developing chamber 98. An opening is provided between the upper edge of the electrode 96 and the mask 90 to define a developer and squeezing air inlet 100, and another opening is provided between the lower edge of the electrode 96 and the mask 90 to define a developer and squeezing air outlet 102.

The surface of the mask 90 of the developing chamber is smoothed so as to exhibit a high draining efficiency.

The developer and squeezing air inlet 100 is communicated with a passage 104 constituted by the internal space of the processing head 54. The passage 104 is communicated with a developer supply port 106 provided in the rear side of the processing head 54 and also with a squeezing air supply port 108 which is formed below the port 106. The developer and squeezing air outlet 102 is communicated with a passage 110 defined by a space inside the processing head 54. The passage 110 is communicated with a developer and squeezing air discharge port 112 which is provided in the rear side of the processing head 54.

Figure 10:
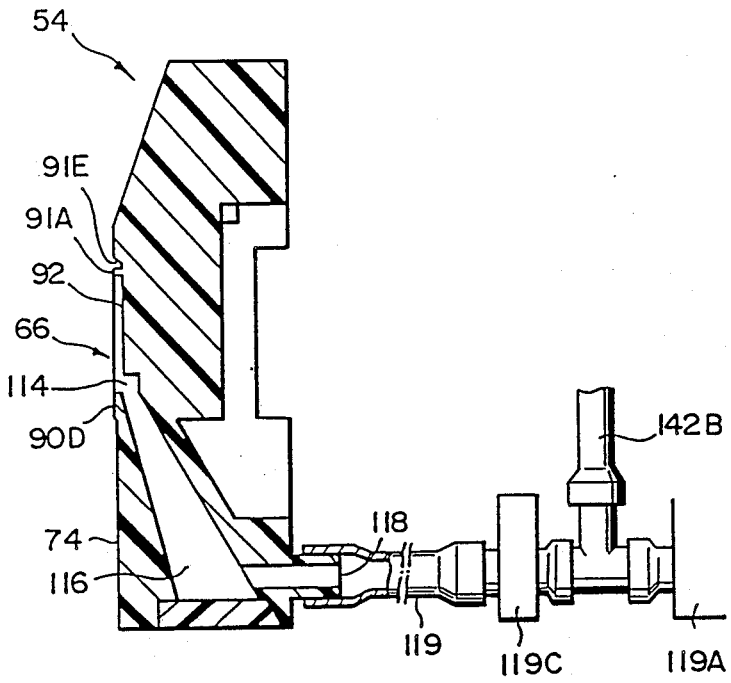
FIG. 10 is a sectional view taken along the line X—X of FIG. 6.

As will be seen from FIG. 10, the portions of the recess 92, located at the corners where the lower frame member 90D intersect the left and right frame members, constitute seal pressure supply ports 114.

From FIG. 10, it will be understood that the seal pressure supply ports 114 are communicated with a passage 116 which is constituted by an internal space of a processing head 54. The passage 116 in turn communicates with a seal pressure inlet 118 formed in the rear side of the processing head 54. The seal pressure supply port 118 is connected to a pump 119A through a conduit 119. A solenoid valve 119C is disposed in an intermediate portion of the conduit 119.

Figure 11:
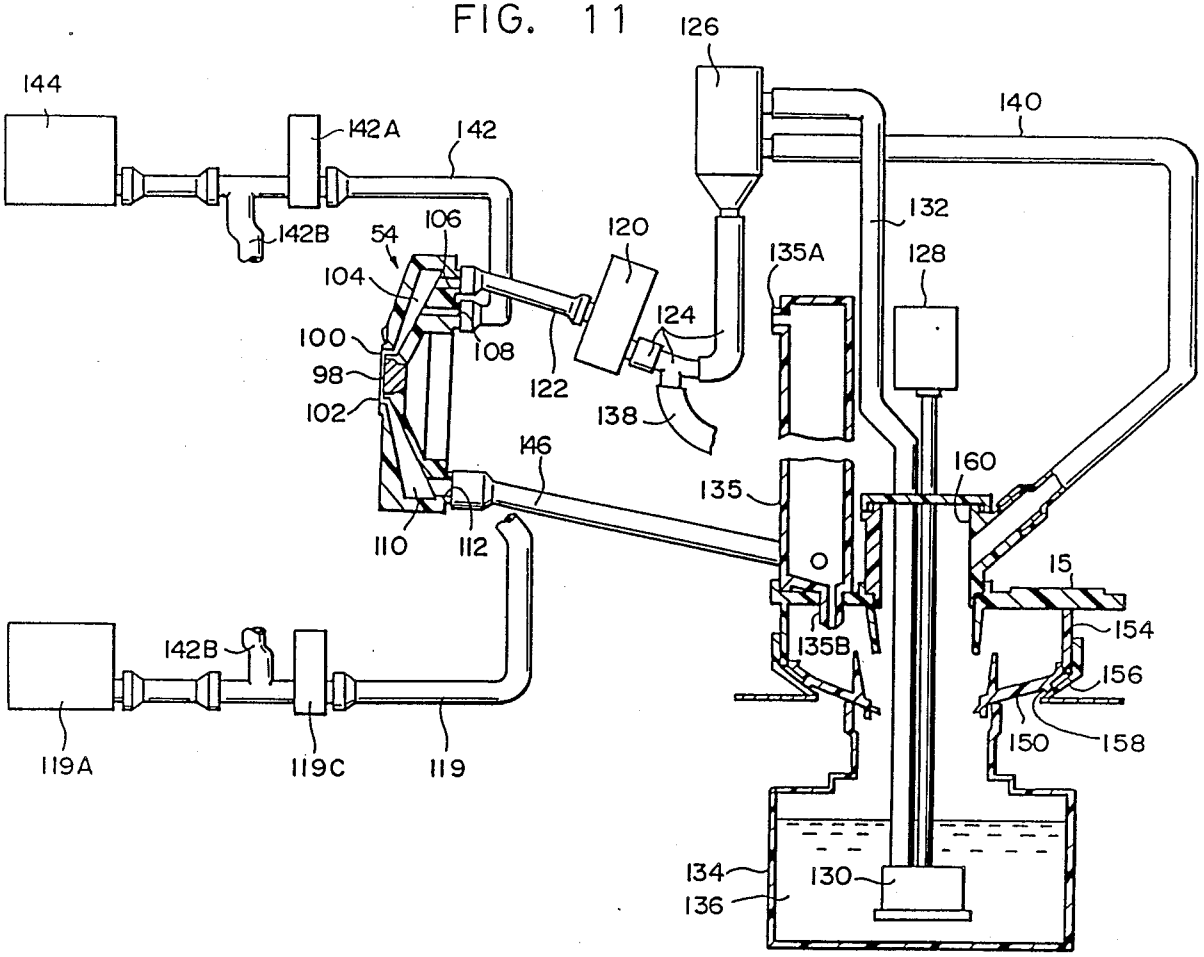
FIG. 11. is an illustration of a developing section in the processing head in relation to other devices.

Referring now to FIG. 11, the developer supply port 106 is connected to a developer tank 126 through conduits 122 and 124 past the solenoid valve 120. The developer tank 126 is set at a level above the level of the solenoid valve 120. A developer pump 130 driven by a motor 128 is connected to the developer tank 126 through a conduit 132. The developer pump 130 is disposed in a developer bottle 134 which contains a developer 136 composed of toner particles dispersed in a solvent.

The conduit 124 between the solenoid valve 120 and the developer 126 has a branch which constitutes a return conduit 138 opening in the developer bottle 134. A return conduit 140 which opens in the developer bottle 134 is connected to the developer tank 126.

The squeezing air supply port 108 is connected through a conduit 142 and a solenoid valve 142A to a squeezing air pump 144 so that it supplies pressurized squeezing air pumped by the air pump 144. The conduit 142 is connected at its portion between the squeezing air pump 144 and the solenoid valve 142A to the portion of the conduit 119 between the solenoid valve 119C and the pump 119A, through a conduit 142B. Thus, the conduit 142B enables the air from the squeezing air pump 144 and the pump 119A to be supplied both to the solenoid valve 142A and the solenoid valve 119C, thus ensuring stable supply of air to these solenoid valves. The level of the pressure of the seal air supplied to the recess 92 is maintained not lower than 1,200 $mmH_2O$, while the squeezing air supplied to the developing chamber 98 is maintained on the order of 400 to 500 $mmH_2O$, by suitably varying the diameters of the conduits 142 and 119 and/or providing a suitable orifice (not shown) in a suitable portion of the conduit system.

A return conduit 146, which is connected to the aforementioned developer and squeezing air outlet 112, opens in a gas-liquid separator 135 attached to the developer bottle 134. A frusto-conical saucer 150 is mounted on the developer bottle 134. The lower end of the saucer 150 slightly projects inwardly of the developer bottle 134 and the underside of the saucer 150 hermetically contacts the upper end of the developer bottle 134 so as to close the developer bottle 134.

The arrangement is such that, when the motor 128 is lifted, the developer pump 130 also is raised so that a lower flange on the pump 130 engages with the brim of the saucer 150, whereby the saucer 150 is withdrawn together with the pump 130, thereby allowing the developer bottle 134 to be replaced.

During the upward movement, the saucer 150 slides along the inner peripheral surface of a cylindrical member 154 which is suspended vertically from a supporting plate 152. The saucer member 150 has a downward annular projection 158 which resiliently engages, when the saucer is in the lowered position as shown in FIG. 11, with a tapered resilient sheet 156 attached to the cylindrical member 154 thereby sealing the interior of the developer bottle 134 from the ambient air.

Another cylindrical member 160 is fixed to the supporting plate 152. The return conduit 140 is communicated with the interior of this cylindrical member 160. The aforementioned gas-liquid separator 135, which is located adjacent to the cylindrical member 160, is provided with a communication port 135A formed in a portion of the side wall near the top end thereof and communicating with the ambient air. A discharge conduit 135B projects downward from the bottom of the gas-liquid separator 135 through a hole formed in the supporting plate 152 so as to return only the liquid content into the developing bottle 134.

In FIG. 11, the processing head 54 is illustrated at a slight inclination. This is because the processing head 54 is inclined in such a manner as to set the optical axis of the optical system perpendicularly to the screen 16 which is installed at an inclination.

[Drying Section]

As shown in FIGS. 5 and 6, the drying section 68 has a frame wall 164. The frame wall 164 is composed of an upper frame member 164A which is a horizontal extension of the upper frame member 91A of the developing section 66 and a right frame member 164C which depends from the end of the upper frame member 164A so as to oppose the right frame member 90D of the developing section 66. The upper frame member 164A and the right frame member 164C have the same height as the outer frame 91 and the mask 90 in the developing section 66. The frame wall 164 further has a lower frame member 164D disposed between the right frame member 164C of the drying section 68 and the right frame member 90C of the developing section 66 and having a projection height smaller than that of these frame members. A hole 165 for mounting a heater is formed in this lower frame member 164D.

A drying region 174 in the drying section 68 is defined by the upper frame member 164A, right frame member 164C and the lower frame member 164D of the drying section 68 and also by the right frame member 91C of the developing section 66. The bottom surface 170 of the drying region 174 thus defined is of the same projection height as the front wall 168 which is recessed from the front wall 74 under the drying section 68 and the fixing section 70.

The size of the region inside the frame wall 164 is greater than that of the developing mask 90.

A guide projection 77, which is extended through a region above the developing section 66, is positioned above the upper frame member 164A. This guide projection 77 has the same role as the guide projection 77 of the charging/exposure section 64 and the guide projection 93 of the developing section 66. The span of the region inside the frame wall 164, i.e., the distance between the right frame member 164C of the drying section 68 and the right frame member 91C of the developing section 66, is greater than the width of opening of the mask 90. The lower surface of the upper frame member 164A, i.e., the surface facing the drying region, is positioned at a level above that of the mask 90 of the developing section 66.

Figure 12:
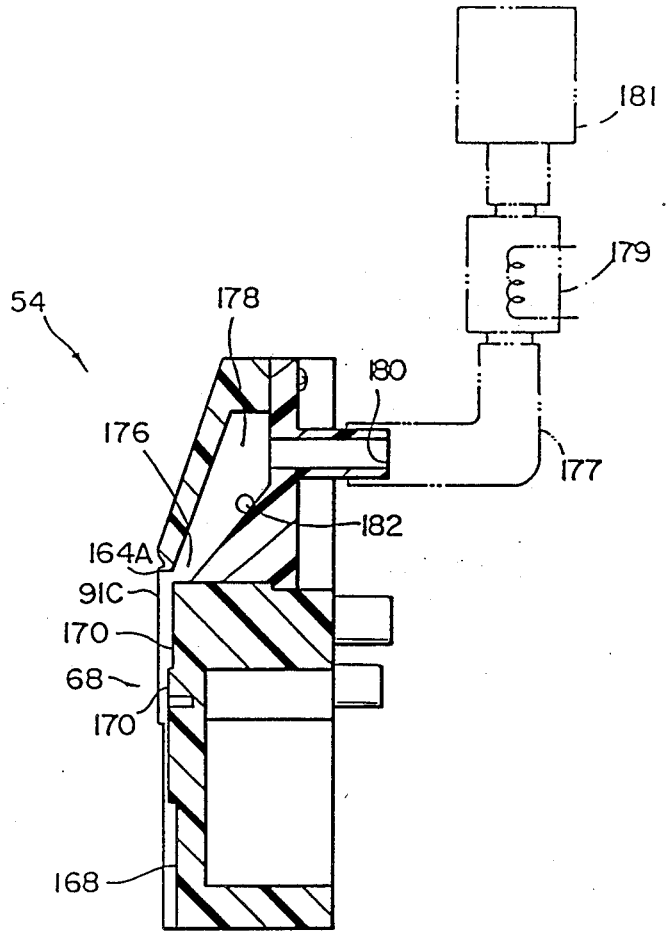
FIG. 12 is a sectional view taken along the line XII—XII of FIG. 6.

As will be seen from FIGS. 6 and 12, the lower portion of the upper frame member 164A is slit so as to constitute a heated air outlet 176. The heated air outlet 176, as will be seen from FIG. 12, communicates with a passage 178 which is constituted by the space inside the processing head 54. The passage 178 communicates with a heated air supply port 180 which opens in the rear wall of the processing head 54. A temperature sensor 182 is disposed in the passage 178. An air pump 181 is connected to the heated air supply port 180 through a conduit 177 having a heater 179 so that heated air is supplied into the passage 178.

The bottom wall 170 of the drying section has a pair of circular holes 180 which serve as leader holes for electric wiring to the heater which may be attached to the bottom wall 170.

[Fixing Section]

The fixing section 70 is, as shown in FIGS. 5 to 7, defined between the right frame member 164C of the frame 164 and the right-hand end portion of the front wall 74. The fixing section 70 has a frame 184 which consists of a lower frame member and left and right frame members, the frame 184 being located at a position which is further depressed from the recess 168 in the front wall 74. A transparent glass plate 186 is fitted in the frame 184. The space provided on the front side of the glass plate 186 defines a fixing chamber 188.

Figure 13:
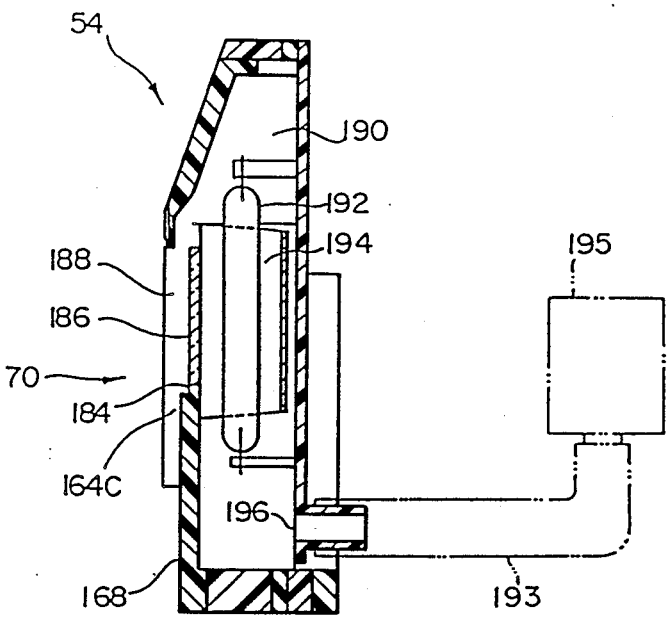
FIG. 13 is a sectional view taken along the line XIII—XIII of FIG. 6.

As shown in FIG. 13, a xenon lamp 192 and a reflecting plate 194 are disposed within a space 190 inside the processing head 54 which is provided on the reverse side of the glass plate 186. A cooling air inlet 196 opens into the space 190 so that cold air is supplied to the space 190 from an air pump 195 through a pope 193. The space 190 and the fixing chamber 188 are communicated with each other through the area defined at the upper edge of the glass plate 186.

[Blip Sensor]

Referring to FIGS. 5 and 6, the processing head 54 has a blip sensor 196 which is disposed on the left-hand end portion of the front wall 74. The blip sensor 196 is located in alignment with a path along which the blip marks 24A printed on the electrophotographic film 24 pass as the film 24 being moved along the front side of the processing head 54. Thus, when each blip mark 24A passes, the blip sensor 196 detects interception of the light from a light source for the sensor 196 which is disposed in opposing relation to the sensor 196 across the film 24.

[Film Pressing Mechanism]

Figure 14:
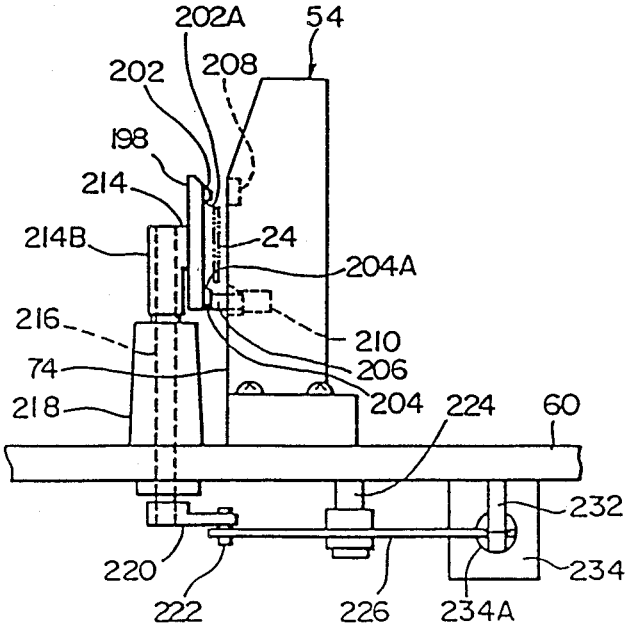
FIG. 14 is a schematic side elevational view of an essential portion of the present invention, illustrating the positional relationship between the processing head and a pressing plate.

As shown in FIGS. 7 and 14, a pressing plate 198 serving as the film pressing means is disposed in front of the front wall 74 of the processing head 54. The pressing plate 198 is, as shown is FIG. 15, provided with a rectangular through-hole 200 which is a size smaller than the opening defined by the mask 76 formed in the charging exposure section 64. The pressing plate 198 is disposed in such a manner that the through-hole 200 opposes the mask 76.

Figure 15A:
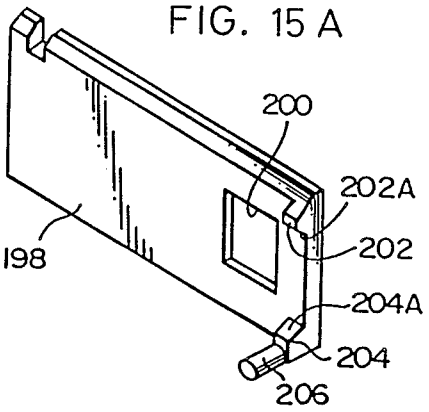
FIG. 15A is a perspective view of a portion of the film pressing mechanism as seen from the opposite side to FIG. 15.
Figure 15:
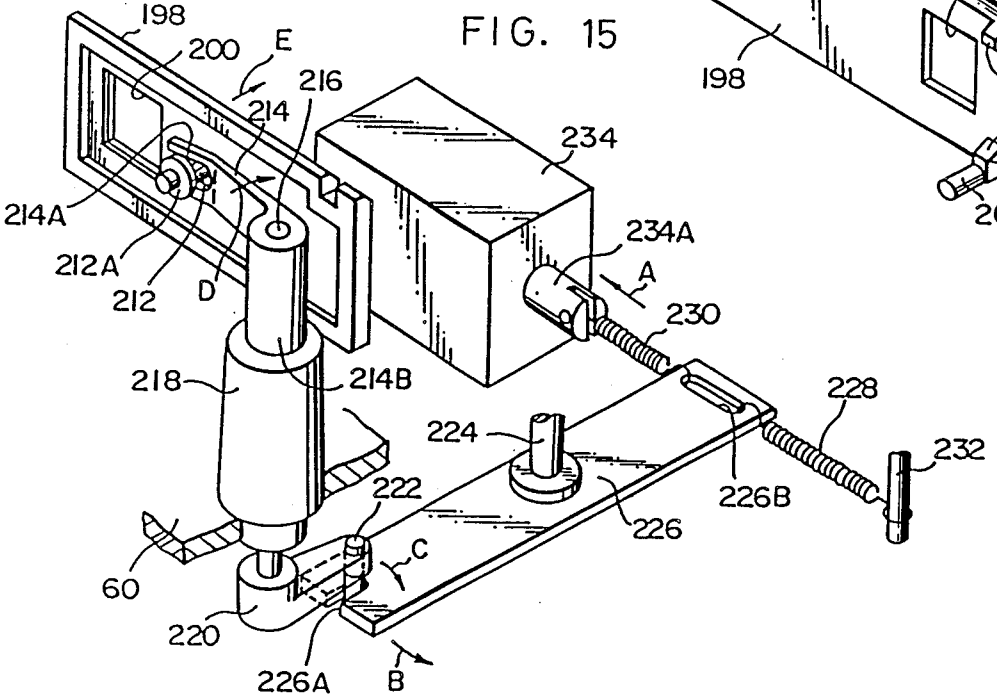
FIG. 15 is a perspective view of a film pressing mechanism provided on the processing head.

As will be seen from FIG. 15A which is a perspective view as viewed in the direction opposite to FIG. 15, the pressing plate 198 have claws 202, 204 which are formed at an upper portion and a lower portion thereof near the end having the through-hole 200, such as to project towards the processing head 54. The opposing surfaces of these claws 202 and 204 are slanted as at 202A and 204A. As will be understood from FIG. 14, the distance between upper and lower claws 202, 204 as measured at base portions of these claws is substantially the same as, more precisely slightly greater than, the width of the electrophotographic film 24. A columnar portion 206 is formed on the claw 204 so as to project therefrom. These claws 202 and 204 are adapted to be received in holes 208 and 210 which are formed in the front wall 74 of the processing head 54.

The pressing plate 198 has a columnar portion 212 projecting from the reverse surface thereof, that is, the surface thereof which is remote from the processing head 54. This columnar portion 212 is engaged with a notched portion 214A formed at one end portion of an arm 214. A stop ring 212A is rigidly secured to the distal end portion of the columnar portion 212 so as to prevent the notched portion 214A from coming off the columnar portion 212. A boss portion 214B is formed at the other end of the arm 214. A shaft 216 is rigidly secured to the boss portion 214B.

The shaft 216 is rotatably fitted into and thereby supported by a stand 218 projecting from the frame 60 to which the processing head 54 is secured, the lower end portion of the shaft 216 projecting from the reverse surface of the frame 60. A first lever 220 is rigidly secured to the projecting lower end portion of the shaft 216. A pin 222 is rigidly secured to the distal end portion of the first lever 220.

A shaft 224 is suspended from the reverse side of the frame 60. The shaft 224 pivotally supports the intermediate portion of a second lever 226. A notched portion 226A is formed at one end of the second lever 226, and the pin 222 is engaged with the notched portion 226A. A slot 226B is formed in the other end portion of the second lever 226, and one end portion of each of the tension coil springs 228 and 230 is retained by the slot 226B, the springs 228 and 230 biasing the second lever 226 in the opposite directions to each other so as to support the lever 226 resiliently.

The other end portion of the tension coil spring 228 is retained by a pin 232 suspended from the reverse side of the frame 60, while the other end portion of the tension coil spring 230 is retained by a plunger 234A of a pull-type solenoid 234 which is secured to the reverse side of the frame 60.

When the solenoid 234 is not energized, the pressing plate 198 is separated from the processing head 54. In this state, the pressing plate 198 is supported in such a manner that the columnar portion 206 is fitted into the bore 210 as shown in FIG. 14.

When the solenoid 234 is energized, the plunger 234A is activated to move in the direction of the arrow A, causing the tension coil springs 228 and 230 to be expanded against the biasing forces. In consequence, the second lever 226 is pivoted about the shaft 224 in the direction of the arrow B, so that the first lever 220 is pivoted about the pin 222 in the direction of the arrow C, thus causing the shaft 216 to turn in the same direction. Thus, the arm 214 is pivoted in the direction of the arrow D so to press the pressing plate 198 in the direction of the arrow E.

Therefore, the pressing plate 198 is made to move in the direction of the arrow E with the columnar portion 206 guided by the hole 210, thereby urging the electrophotographic film into contact with the masks 76, 90 and the end surface of the frame wall 164. Any heightwise misalignment of the electrophotographic film 24 is corrected during this movement of the pressing plate 198 because the slanted surfaces 202A and 204A of the claws 202 and 204 serve as guides which are capable of urging the upper edge and the lower edge of the film 24 downward and upward, respectively.

The pressing plate 198, when keeping the electrophotographic film in contact with the processing head 54, is correctly located with respect to the processing head 54 because the claws 202 and 204 are received in the holes 208 and 210. In this state, the pressing plate 198 is resiliently urged by the coiled springs 228, 230 so as to press the electrophotographic film in a resilient manner.

As the solenoid 234 is de-energized, the second lever 226 is pivoted in the direction counter to the direction of the arrow B by the force of the tensile spring 228, so that the arm 214 is rotated in the direction counter to the direction of the arrow D. In consequence, the notched portion 214A presses the stop ring 212A, causing the pressing plate 198 to move counter to the direction of the arrow E.

[Operation]

The following is a description of the operation of this embodiment.

The electrophotographic apparatus is arranged such that, when the power supply switch is turned ON, the cassette loading section 26 (shown in FIG. 1) is raised, thereby allowing a cassette accommodating the electrophotographic film 24 to be loaded into the section 26. After the cassette has been loaded into the cassette loading section 26, the operator pushes down the section 26 to the initial position by a manual operation. In consequence, the cassette loading section 26 is locked at said position. In this state, the film 24 is positioned as shown in FIG. 14 and is allowed to move along the front side of the processing head 54 by the operation of a film moving motor (not shown).

When the image of the document 34 (shown in FIG. 2) is to be recorded on the film 24, the film moving motor is activated to move the film 24 in such a manner that a given frame which is selected from the unexposed frames as desired is positioned in from of the mask 76 in the charging exposure section 64. This operation is executed by designating a desired frame through the control keyboard 28 shown in FIG. 1. The positioning of the selected frame with respect to the charging exposure section 64 is effected by virtue of the blip sensor 196 which counts the number of blip marks 24A from a reference point.

Figure 16:
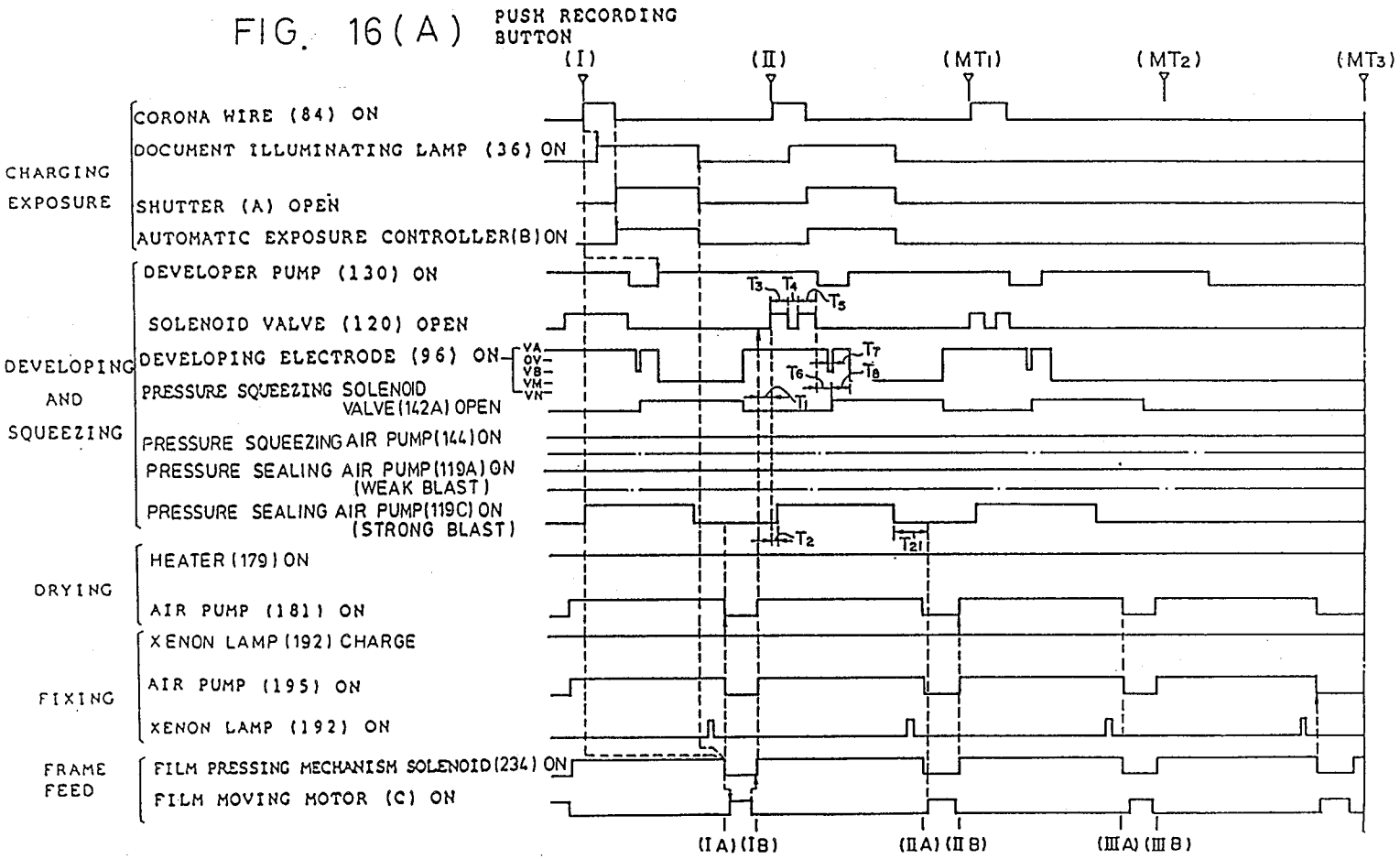
FIGS. 16A and 16B are time charts showing the operation of the electrophotographic apparatus in camera mode.
Figure 16B:
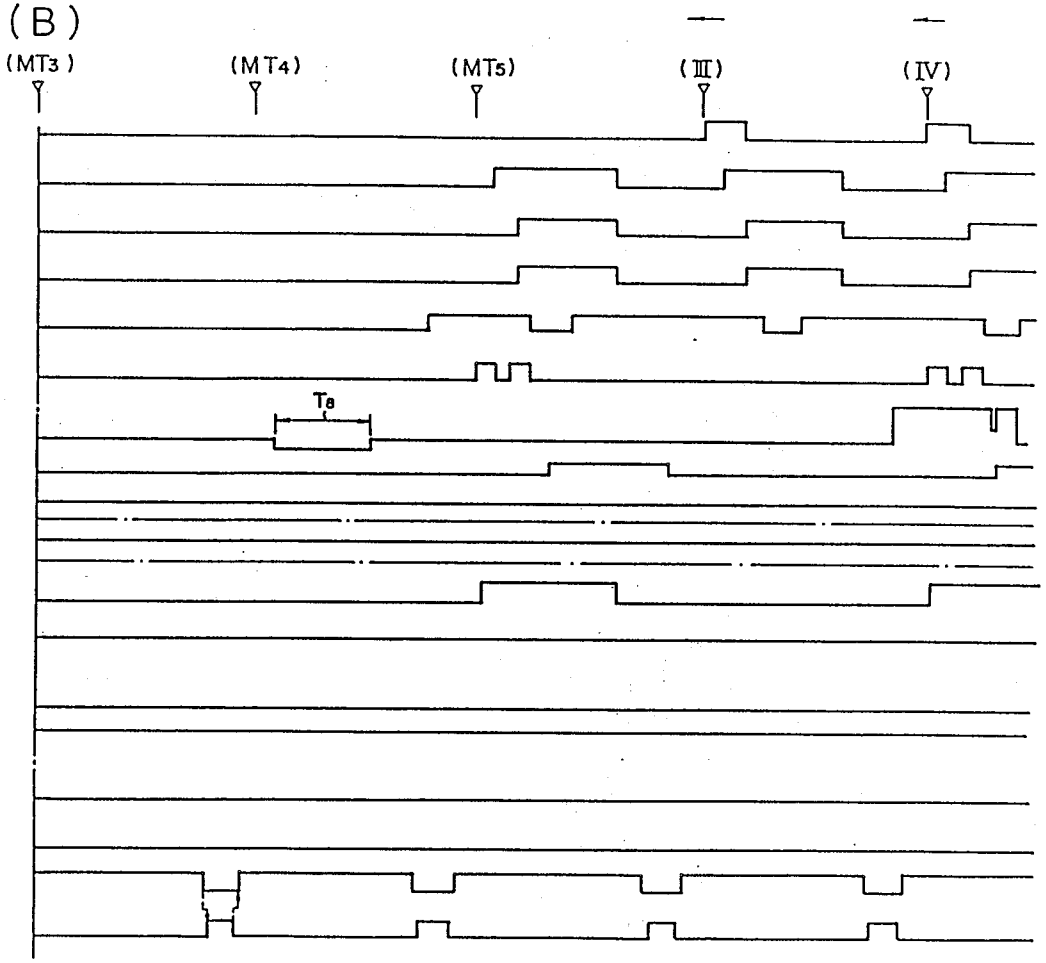

FIGS. 16A and 16B are time charts showing the operation of the apparatus in the case where a given frame is positioned as described above and subjected to recording and, subsequently, continuous recording is effected on each of the frames which consecutively follow the first recorded frame. In the processing head 54, when the frame positioned at the charging exposure section 64 is being subjected to charging and exposure operations, frames which are respectively positioned at the developing section 66, the drying section 68 and the fixing section 70 are simultaneously subjected to different kinds of processing, respectively. However, the following description will specifically mention one the frames which is to be subjected to recording when the recording button is pressed at the timing (I) in FIG. 16 to start recording.

Recording of the document 34 is made possible by selecting the camera mode through the control keyboard 28. Simultaneously with this mode selecting operation, the heater 179 for heating air sent to the drying chamber 174 is energized so as to generate heat, and a capacitor for the xenon lamp 192 in the fixing section 70 is supplied with current so as to be charged. These operations are continued while the camera mode is being selected.

When the recording button on the control keyboard 28 is pressed, a high voltage is applied to the corona wire 84 in the charging exposure section 64, causing a corona discharge to occur between the corona wire 84 on one hand and the proximity and mask electrodes 80 and 82 on the other. Thus, the surface of the photosensitive layer of a portion of the film 24 which is positioned within the opening defined by the mask 76 is charged positive.

At the time when the recording button is pressed, the solenoid 234 in the film pressing mechanism has continuously been excited from the previous step. Therefore, the film 24 is pressed by the pressing plate 198 so as to be in pressure contact with the respective end faces of the masks 76, 90 and the frame 164 of the processing head 54. The pressing plate 198 has the through-hole 200 formed in a portion thereof which opposes the mask 76, but this through-hole 200 is smaller than the opening defined by the mask 76. Therefore, a portion of the film 24 which is positioned at the end face of the mask 76 is pressed by the surface of a portion of the pressing plate 198 around the through-hole 200. Accordingly, the film 24 is reliably brought into close contact with the end face of the mask 76, and the charging range is thereby accurately limited within the opening in the mask 76.

Since the mask electrode 82 provided in the charging-/exposure chamber 72 is maintained at a potential substantially equal to the potential of the charged film 24, the peripheral edge portion of a frame of the film 24 which is positioned at the opening in the mask 76 is also charged at a value close to the potential at the central portion of said frame, thus enabling the whole of a frame of the film 24 to be uniformly charged. The mask electrode 82 can be maintained at a potential substantially equal to the potential of the charged film 24 by appropriately selecting the value of a resistor (not shown) electrically connected between the ground and the mask electrode 82, or by applying a bias voltage to the mask electrode 82 from an external power supply (not shown).

The document illuminating lamp 36 is turned ON when a predetermined period of time has elapsed after the recording button has been pressed at (I) in FIG. 16, so as to illuminate the document 34 placed on the glass plate 22 of the document table 18. Further, when a predetermined period of time has elapsed after the recording button has been pressed, the supply of current to the corona wire 84 is suspended, thus completing the corona discharge operation.

At the same time as the suspension of the energization of the corona wire 84, a shutter (not shown but indicated by the reference symbol A in FIG. 16) is opened, and the light reflected from the document 34 placed on the document table 18 is applied to the film 24 by the optical system shown in FIG. 2. In addition, the automatic exposure controller (not shown but indicated by the reference symbol B in FIG. 16) simultaneously starts integration of the quantity of light.

On the other hand, when a predetermined period of time has elapsed after the recording button has been pressed, the motor 128 shown in FIG. 11 is activated to start the operation of the developer pump 130, whereby the developer 136 in the developer bottle 134 is pumped up into the developer tank 126. The developer 136 thus pumped falls from the developer tank 126 by the force of gravity towards the processing head 54 through the conduit 124. In this state, however, the solenoid valve 120 is still kept closed so that the developer 136 is returned to the developer bottle 134 via the return conduit 138. When the level of the developer 136 in the developer tank 126 is raised to a predetermined limit, the developer 136 is returned to the developer bottle 134 through the return conduit 140.

Thus, the developer 136 is circulated between the developer bottle 134 and the developer tank 126 and is stopped at the upstream side of the solenoid valve 120 until the solenoid valve 120 is opened. This recirculation produces an appreciable stirring effect on the developer 36 in the developer bottle 134.

When the integrated value of the quantity of light reaches a set value, the integration effected by the automatic exposure controller (B) is suspended and, at the same time, the shutter (A) is closed, and the document illuminating lamp 36 is turned OFF. At this point of time, the exposure step is completed and, one frame of the film 24 in a portion thereof which is positioned at the opening defined by the mask 76 has an electrostatic latent image formed thereon owing to the fact that the electric charge on the photosensitive layer is reduced in accordance with the image pattern on the document 34. Since factors in changes of the image density, such as variations in the ground density of the document 34 and variations in the voltage applied to the document illuminating lamp 36, are corrected by the automatic exposure controller (B), an optimal exposure operation is effected at all times. When a predetermined period of time has elapsed after the recording button had been pressed and all the steps of processing other frames have already been completed, the solenoid 234 of the film pressing mechanism is immediately de-energized. When the solenoid 234 is de-energized at the timing (IA) in FIG. 16, the pressing plate 198 is separated form the film 24.

When a predetermined period of time has elapsed after de-energization of the solenoid 234 of the film pressing mechanism, the film moving motor (not shown but indicated at C in FIG. 16) is started so as to effect a one-frame feed of the photographic film 24 rightward as viewed in FIG. 6. In consequence, the frame which has been positioned in the charging/exposure section 64 is moved to the developing section 66. The feed of the electrophotographic film 24 is controlled in accordance with the signal from the blip sensor 196 capable of sensing the blip mark 24A so that the amount of feed precisely coincides with the pitch of the frame, as explained before.

When a predetermined time has elapsed after the stop of the film moving motor C, the solenoid 234 of the film pressing mechanism is energized at a moment (IB) in FIG. 16, thereby causing the pressing plate 198 to press the electrophotographic film 24 onto the processing head 54. In this state, the squeezing air pump 144 and the pump 119A have been started, but the solenoid valves 142A and 19C are still closed.

When the solenoid valve 120 is opened after elapse of a predetermined time $T_1$ which is typically 0.3 second, the developer 136 is allowed to reach the processing head 54 through the conduit 122, and the developer 136 then flows into the developing chamber 98 from the developer and squeezing air inlet 100 in the developing section 66. Since the toner particles dispersed in the developer 136 are charged negative, the toner particles, when flowing down through the developing chamber 98, these toner particles adhere to portions of the film 24 which have been charged positive, thereby developing the electrostatic latent image. The developer 136 having flowed down through the developing chamber 98 is returned to the developer bottle 134 from the developer and squeezing air outlet 102 through the return conduit 146.

The presence of the developing electrode 96 ensures a high quality of developed image without any edge effect. The application of a biasing voltage VA to the developing electrode 96 effectively prevents fogging of the developed image.

The diameters of the conduits and other parameters of the developer supply system are so determined that the developer supplied from the developer tank 126 to the conduit 124 is partially returned to the developer bottle 134 through the return conduit 138, while the remainder part of the developer is directed to the solenoid valve 120. The solenoid valve 119C is opened when a predetermined time $T_2$ which is typically 0.1 second has elapsed after the opening of the solenoid valve 120. So that pressurized seal air is supplied into the recess 92. The supply of the pressurized seal air is maintained for a period of about 1.2 second, till a moment $T_{21}$ before the feed of the film. In this embodiment, the delay time $T_2$ is employed for the purpose of allowing the developer to flow down before the pressurized seal air is supplied. This, however, is not essential and no substantial problem is caused even if the solenoid valves 120 and 119C are opened simultaneously. The solenoid valve 120, when a predetermined time $T_3$ which is typically 0.4 second has elapsed after the opening, is closed again and is kept in the closed state for a predetermined period $T_4$ which is typically 0.2 second and, thereafter opened for a predetermined period $T_5$ which is typically 0.4 second and then closed finally. Simultaneously, the developer pump 130 is stopped. The biasing voltage applied to the developing electrode 96 is inverted temporarily for a short period $T_7$ which is typically 30 ms immediately before the opening of the solenoid valve 142A. In consequence, the attaching of the negatively charged toner particles to the electrophotographic film 24 is facilitated so as to attain a high clarity of the image even in delicate or fine portions of the image.

Since the electrophotographic film 24 is pressed by the pressing plate 198 onto the end surface of the mask 90, there is no substantial risk for the developer 136 flowing down through the developing chamber 98 to come into the gap between the end surface of the mask 90 and the electrophotographic film 24.

When a predetermined period $T_6$ which is typically 0.5 second has elapsed after closing of the solenoid valve 120, the solenoid valve 142A for the pressurized squeezing air is opened so that pressurized squeezing air of 400 to 500 $mmH_2O$ is supplied into the developing chamber 98 through the developer and squeezing air inlet 100, thereby blasting any excessive liquid developer 136 off the surface of the electrophotographic film 24. The liquid developer which has come off the electrophotographic film 24 is returned to the developer bottle 134 through the developer and squeezing air outlet 102 and then through the return conduit 146.

The supply of the seal air to the recess 92 is commenced in advance of the opening of the solenoid valve 142A. The pressure of the seal air is not lower than 1200 $mmH_2O$ which is sufficiently higher than the squeeze air pressure. In consequence, the seal air is allowed to flow into the developing chamber 98 beyond the members constituting the mask 90 form the entire periphery of the developing chamber 98. The sealing air thus flowing into the developing chamber 98 vigorously stirs the developer 136 supplied into the developing chamber 98. Bubbles in the liquid developer 136, if any, are therefore strongly agitated so that they do not stand still. Therefore, any degradation of the quality of the developed image which may otherwise be caused by stagnation of bubbles ia avoided. In order that the pressurized seal air is allowed to come into the developing chamber 98 from the entire periphery thereof, it is desired that the center of the pressing force exerted by the pressing plate 198 is positioned on the center of the developing chamber 98. The pressing force exerted by the pressing plate 198 may be not greater than 600 g.

The pressurized seal air rushing into the developing chamber 98 also blow off any portion of the liquid developer attaching to corners of the developing chamber 98, thus preventing such portion of the developer from attaching to the image portion of the film, whereby undesirable contamination at the frame portion of the developed image is eliminated.

When a predetermined time. e.g., 0.5 second, has elapsed after the opening of the solenoid valve 142A, the bias voltage applied to the developing electrode 96 is changed to VM which is, as mentioned before, −140 volts. In consequence, the toner particles attaching to the surface of the developing electrode 96 are repelled and separated from the developing electrode 96. The application of this negative bias is conducted after most of the liquid developer is forced out the developing chamber 98. It is preferred that the application of the negative bias voltage is conducted before the surplus developer is dried by the squeezing air which is supplied by the squeezing air pump 144 as a result of opening of the solenoid valve 142A. This also suggests that the application of the negative bias voltage is preferably conducted at a moment $T_8$ (about 0.5 second or so) after the opening of the solenoid valve 142A.

It will be seen that the portion of developer which attaches to the developing electrode in each developing operation can be separated so that the period in which the developing electrode is used without regeneration or repair can be increased advantageously.

The supply of the squeezing air is controlled by the charging/exposure process of the next film frame which is commenced as the photographing button is pressed at (II) in FIG. 16. The supply of the squeezing air is stopped simultaneously with the start of the film moving motor C after elapse of a predetermined time from the moment ((IIA) in FIG. 16) at which the solenoid 234 of the film pressing mechanism is de-energized, whereby the developing and squeezing process is completed.

When film moving motor C is stopped, the electrophotographic film 24 has been fed to the right as viewed in FIG. 6 by a distance corresponding to the pitch of the frames. Thus, the frame which was placed in the developing section 66 before the film feed is set in the drying section 68. When a predetermined time has passed after the stopping of the film moving motor C, the solenoid 234 of the film pressing mechanism is started at (IIB) in FIG. 16. At the same time, the air pump 181 shown in FIG. 12 is started so that heated and pressurized air is supplied through the conduit 177. The heated air heated by the heater 179 is blown into the drying chamber 174 through the heated air outlet 176 of the drying section 68. The operation of the air pump 181 is under the control of the charging/exposure process of the frame commenced by pressing of the photographing button at (III) in FIG. 16. When the solenoid 234 of the film pressing mechanism is de-energized at (IIIA) in FIG. 16, the air pump 181 is stopped thereby completing the drying operation.

The temperature of the heated air supplied to the drying chamber 174 is sensed by the temperature sensor 182 so that the temperature is maintained constant by an automatic control.

The drying chamber is larger in size than the developing chamber so that the film which has been wetted through development can be dried entirely even at its peripheral edge portions.

Although in the above-described embodiment the drying air pump 181 is activated in response to the energization of the solenoid 234 of the film pressing mechanism and only when the film 24 is being pressed against the processing head 54, the air pump 181 may be operated at all times from the start of the operation of the apparatus.

After the solenoid 234 of the film pressing mechanism has been de-energized at the position (IIIA) in FIG. 16, the film moving motor (C) is activated, and the frame which has been positioned at the drying section 68 is thereby moved to the fixing section 70. After the drive of the film moving motor (C) has been suspended, the solenoid 234 of the film pressing mechanism is energized at the position (IIIB) in FIG. 16 and, at the same time, the air pump 195 shown in FIG. 13 is activated to supply cold air to the space 190 in the fixing section 70. The cold air supplied to the space 190 passes through the area defined at the upper edge of the glass plate 186 to reach the fixing chamber 188.

When a predetermined period of time has elapsed after the solenoid 234 of the film pressing mechanism has been energized, the xenon lamp 192 is turned ON, so that the toner particles are fused and fixed to the surface of the film 24, thus completing the fixing step.

Any matter which is vaporized or scattered during the fixing operation is blown off by means of the cold air supplied from the air pump 195, and there is no fear of such matter adhering to the surface of the glass plate 186.

When the above-described steps are finished, the recording of an image on the electrophotographic film 24 is completed.

In the apparatus according to this embodiment, the recording is started as the recording button is pressed, and when the recorded frame positioned at the charging exposure section 64 has been moved to the developing section 66 and when a predetermined period of time has elapsed after the solenoid 234 of the film pressing mechanism has been energized, it becomes possible to record a subsequent frame. To effect continuous recording of following consecutive frames, the recording button is pressed during the period starting from the moment at which it becomes possible to record a subsequent frame, so that the recording step is repeated and the processing proceeds as shown in FIG. 16.

When the recording button is not pressed during the above-mentioned period, or when the command to end a series of recording operations is input from the control keyboard 28, the application of a relatively strong blast by the air pump 144 is suspended in accordance with the operation of a timer, and the drying and fixing operations carried out thereafter are also executed under the control of a timer.

A description will be made hereinunder as to a preserving mode of operation of the electrophotographic apparatus. The preserving mode of operation is commenced when an end key on the control keyboard 28 is pressed while a predetermined number of frames, e.g., 1000 frames, on the electrophotographic film have been exposed. It is assumed here that the photographic button is pressed at the moment (II) in FIG. 16, for the exposure of 1000th frame.

The image formed through exposure in response to pressing of the photographic button at the moment (II) is subjected to developing/squeezing step $MT_1$ shown in FIG. 16. In this state, the photographic mode is not commenced even through the exposure button is pressed. In addition, a sign indicating that the photographic is not possible is displayed on the control keyboard 28. Then, drying and fixing are executed in steps $MT_2$ and $MT_3$, respectively. After the completion of the fixing, the biasing voltage VN which is, for example, −1000 volts as mentioned before, is applied to the developing electrode 96 for a predetermined time $T_8$ which is, for example, 30 to 60 seconds, thereby causing the toner particles on the developing electrode 96 to come off this electrode. Then, in step $MT_5$, the developer pump 130 and the solenoid valve 120 operate in the same manner as that in the ordinary developing and squeezing step, so that the toner particles which have come off the developing electrode are collected and returned to the developer bottle 134.

Meanwhile, the conduit 119 and the solenoid valve 119C are controlled in the same manner so as to effect the sealing. The frame of the electrophotographic film 24, which is positioned to face the developing electrode 96 in this case, is a special frame which is determined beforehand specifically for use in the preserving mode, rather than an ordinary frame which is intended for recording images.

Figure 17:
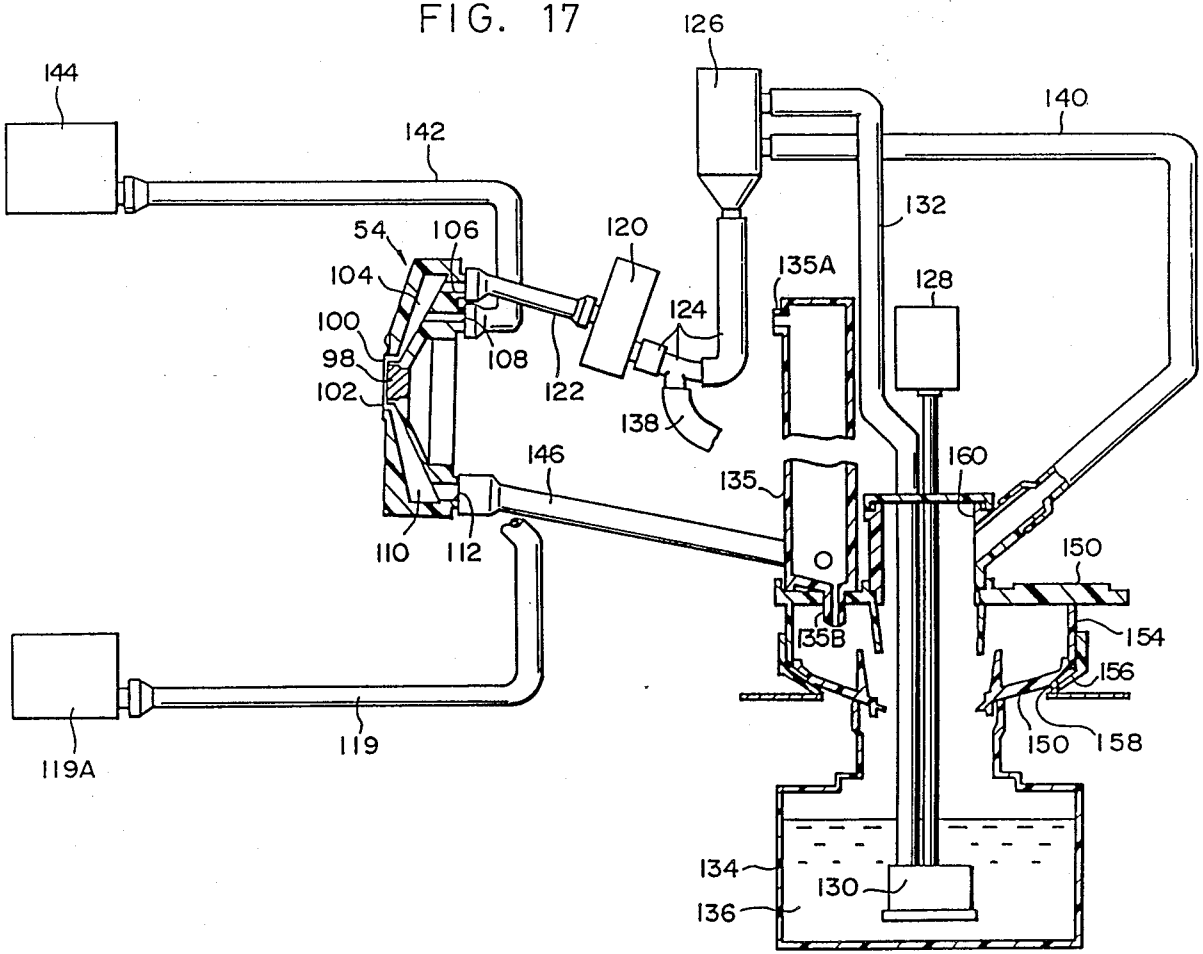
FIG. 17 is a view corresponding to FIG. 11 but showing a second embodiment.

FIG. 17 shows a second embodiment of the present invention. This embodiment is devoid of the conduit 142B, solenoid valve 119C and the solenoid valve 142A which are used in the first embodiment. Thus, the conduit 142 and the conduit 119 are directly connected to the squeezing air pump 144 and the pump 119A, respectively.

In this embodiment also, the developing chamber 98 and the recess 92 are supplied with pressurized squeezing air and seal air, respectively, through the conduit 142 and the conduit 119.

Thus, the second embodiment shown in FIG. 17 can operate satisfactory although the solenoid valves 119C and 142A are omitted, and offers a reduction in the production cost through a reduction in the number of parts employed, in addition to the advantages brought about by the first embodiment.

What is claimed is:

1. A developing method for use in an electrophotographic apparatus of the type having a developing section which is defined by a frame and which is adapted to be supplied with a developer so as to develop an image on an electrophotographic film brought to said developing section, said developing method comprising the steps of:

(a) supplying said developer into said developing section; and (b) supplying a seal section provided around said frame defining said developing section with a seal gas of a pressure higher than the pressure in said developing section, in such a manner as to allow said seal air to flow from said seal section into said developing section thereby stirring said developer in said developing section during development.

2. A developing method according to claim 1, wherein the seal gas supplying step (b) is executed in such a manner as to allow said seal gas to flow into said developing section from the entire periphery of said developing section.

3. A developing method according to claim 1, further comprising the step (c) of supplying said developing section with a pressurized squeezing gas after the completion of the supply of said developer in said step (a).

4. A developing method according to claim 3, wherein the seal gas developer supplying step (b) is executed when a predetermined time has elapsed after the completion of the developer supplying step (b).

5. A developing method according to claim 3, wherein the seal gas developer supplying step (b) is executed simultaneously with the developer supplying step (b).

6. A developing method according to claim 2, wherein said electrophotographic film is pressed towards said developing section at least during execution of the developer supplying step (a) and the seal gas supplying step (b).

7. A developing method for use in an electrophotographic apparatus of the type having a processing head designed for conducting various types of processing on an electrophotographic film and equipped with a developing chamber defined by a protruding frame, said developing chamber being adapted to be supplied with a developer so as to develop an image on said electrophotographic film brought into said developing chamber, said developing method comprising the steps of:

(a) pressing said electrophotographic film onto said frame;

(b) supplying said developer into said developing chamber; and (c) supplying a seal section provided around said frame defining said developing section with a seal gas of a pressure higher than the pressure in said developing section, in such a manner as to allow said seal air to flow from said seal section into said developing section thereby stirring said developer in said developing section during development.

8. A developing method according to claim 7, wherein the seal gas supplying step (b) is executed in such a manner as to allow said seal gas to flow into said developing section from the entire periphery of said developing section.

9. A developing method according to claim 7, further comprising the step of (d) supplying said developing chamber with a pressurized squeezing air when a predetermined time ($t_1$) has elapsed after completion of the developer supplying step (b).

10. A developing method according to claim 9, wherein the seal gas supplying step (c) is executed when a predetermined time ($t_2$) has elapsed after completion of the developer supplying step (b).

11. A developing method according to claim 9, wherein the seal gas supplying step (c) is executed simultaneously with the developer supplying step (b).

12. A developing method according to claim 10, wherein said predetermined times ($t_2$) and ($t_1$) are determined to meet the condition of $t_2 < t_1$.

13. A developing method according to claim 9, wherein said seal gas and said pressurized squeezing gas are air.

* * * * *